United States Patent [19]

Simpson et al.

[11] 4,202,164

[45] May 13, 1980

[54] LUBRICATED PLASTIC IMPREGNATED ARAMID FIBER ROPE

[75] Inventors: Neville H. Simpson; Fred E. Dykeman, both of Kenosha, Wis.

[73] Assignee: Amsted Industries Incorporated, Chicago, Ill.

[21] Appl. No.: 958,339

[22] Filed: Nov. 6, 1978

[51] Int. Cl.[2] ..... D07B 1/16; D07B 5/00; D02G 3/36

[52] U.S. Cl. ..... 57/232; 57/7; 57/231; 57/250; 57/258

[58] Field of Search ..... 57/210, 231, 232, 241, 57/243, 250, 258, 3, 6, 7, 13

[56] References Cited

U.S. PATENT DOCUMENTS

| | | | |
|---|---|---|---|
| 3,318,082 | 5/1967 | Riggs | 57/217 |
| 3,425,207 | 2/1969 | Campbell | 57/217 |
| 3,824,777 | 7/1974 | Riggs | 57/217 X |
| 3,874,158 | 4/1975 | Chiappetta et al. | 57/220 X |
| 3,973,385 | 8/1976 | Roe | 57/217 X |
| 4,016,714 | 4/1977 | Crandall et al. | 57/258 X |
| 4,022,010 | 5/1977 | Gladenbeck et al. | 57/231 |
| 4,050,230 | 9/1977 | Sengo et al. | 57/231 |

*Primary Examiner*—Donald Watkins
*Attorney, Agent, or Firm*—Edward J. Brosius; Fred P. Kostka; John L. Schmitt

[57] ABSTRACT

An aramid fiber rope having a central core surrounded with aramid fiber rope strands. The core and the aramid strands are coated with a heavy viscous lubricant prior to winding the strands into rope. The lubricated rope is then impregnated and surrounded with a plastic material to entrap the lubricant in the core and the strands.

2 Claims, 1 Drawing Figure

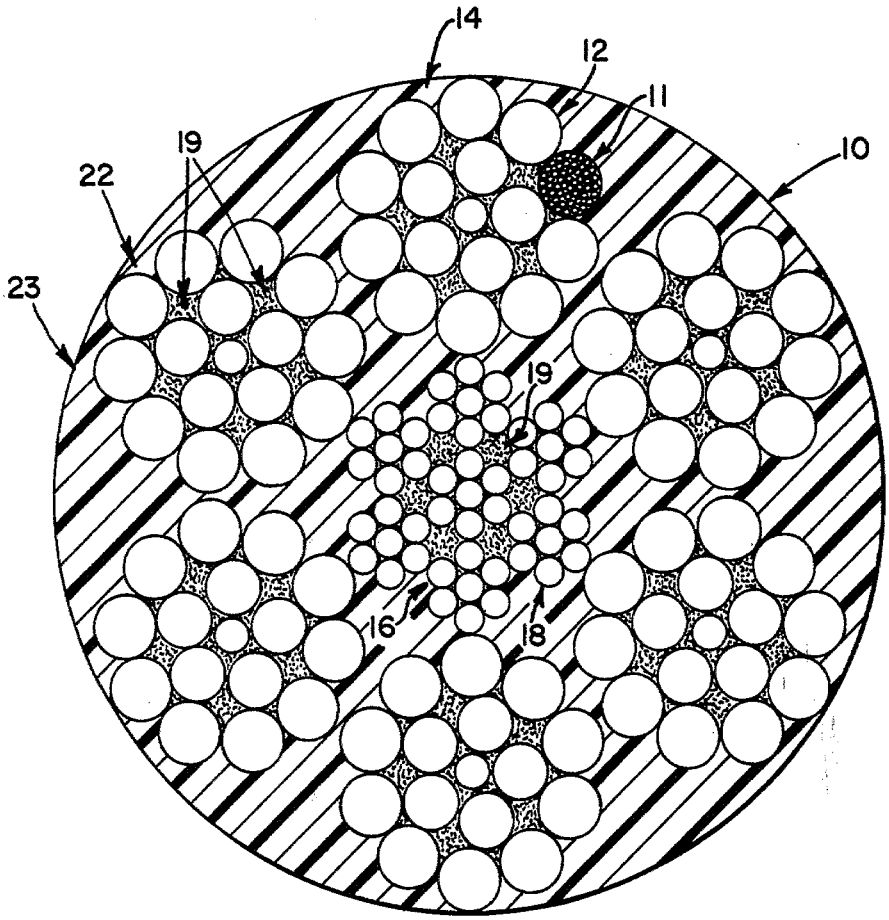
14
12
11
10
19
22
23
19
16
18

LUBRICATED PLASTIC IMPREGNATED ARAMID FIBER ROPE

FIELD OF THE INVENTION

This invention generally relates to a synthetic fiber rope in a wire rope construction, and particularly to a plastic impregnated, lubricated synthetic fiber rope in a wire rope construction and a method for producing the same.

BACKGROUND OF THE INVENTION

The family of aromatic polycarbonamide fibers possessing extremely high strength, high modulus and low elongation are commercially available from the E. I. DuPont de Nemours & Co. under the trade name "Kevlar" and are generally referred to as aramid fibers. Such aramid polymers are described in U.S. Pat. Nos. 3,652,510, 3,673,143 and 3,699,085.

There are many known methods of lubricating aramid fibers such as with various types of waxes and resins for the purpose of improving fatigue life, reducing yarn contact stresses and inhibiting fretting. However, it has been found that prior art lubricated aramid fiber yarns have not always performed satisfactorily, especially in standard wire rope constructions.

Presently known methods for stranding and closing an aramid fiber rope of wire rope type construction produced a rather unstable rope, in that the aramid fiber strands do not retain a "memory" of the preforming step. That is, the strands do not conform to the helix or lay direction of the rope and, therefore, have a tendency to unlay into a stable parallel lay condition. Often this imbalance tends to develop "bird-caging" of the outer strands, especially in multi-strand ropes.

SUMMARY OF THE INVENTION

The present invention provides a method for producing a heavily lubricated aramid fiber rope which is impregnated with a load-bearing plastic such that the viscous lubricant is entrapped in the strands and core. The outside diameter of the plastic impregnated rope conforms to the outside diameter of the external aramid fiber strands. The aramid fiber rope produced by this method has a smooth outer periphery with increased bearing area without increased rope diameter.

The object of the present invention is to provide a lubricated, plastic impregnated aramid fiber rope and a method for making the same.

The plastic impregnation of the aramid fiber rope of the present invention is accomplished by pressurized extrusion of a flexible thermoplastic into the interstices of the rope.

Impregnation of a lubricated aramid fiber rope with plastic in accordance with the present invention inhibits entrance of foreign abrasive particles into the rope, prolongs the lubricant's life inside the rope and in addition, forms a matrix that both supports and locks the individual strands in position relative to each other. Another advantage is a reduction in fiber and yarn building block notching and internal friction because the loads placed on rope are shared substantially equally by the spaced internal aramid fiber building blocks. Furthermore, a lubricated aramid fiber building block rope, impregnated with plastic while holding the outer strands spaced from each other, will have extremely good resistance to fatigue and an increased ultimate breaking strength because of a reduction in internal fiber building block contact, all while maintaining flexibility.

BRIEF DESCRIPTION OF THE DRAWING

The drawing is a cross section view of the plastic impregnated aramid fiber rope.

DESCRIPTION OF THE PREFERRED EMBODIMENT

The present invention utilizes conventional wire rope constructions, such as 10, using aramid fibers 11 wherein individual aramid fiber yarn building blocks 12 are wound into strands 14, and a plurality of strands are formed about a core 16 which is illustrated as formed of a plurality of strands 18. The core 16 could be of a single strand. It should be understood that the core 16 may be formed of natural fiber material such as: sisal or hemp; synthetic materials such as polyolefins, polyamides, or polyvinylchlorides; or metal such as steel or aluminum.

The particular rope shown in the drawing is given by way of example of the preferred embodiment. It should be understood that the plastic impregnating process to be described hereinafter may be applied to any of the various rope configurations utilizing cores of aramid or natural fiber, synthetics or metal. During fabrication of an aramid fiber rope, a viscous lubricant 19 is pumped around each aramid fiber yarn building block 12 as it is formed into strands. Conventional lubricants suitable for this purpose are certain silicones, waxes and cyanaprene.

A flexible thermoplastic 22 is extruded, under pressures sometimes as high as 4,000 PSI into the interstices of the rope or the rope is immersed in a thermoset plastic and subsequently cured, completely filling the interstices down to the outer strands of the core, but not extending outwardly beyond the outer diametrical limits of the rope 10 as indicated at 23. The thermoplastic can be any of those capable of being extruded, such as polypropylene, polyurethane, polyethylene, nylon or tetrafluoroethylene. The thermoset plastics may be any that will penetrate the interstices, conform to the required in-filling of strand valleys, and have a sufficiently low curing temperature such as some plastisol vinyl plastics.

What is claimed is:

1. A rope comprising a central core, said central core being comprised of a plurality of aramid fiber strands laid around a central core strand, said strands being lubricated with a heavy, viscous lubricant, a plurality of aramid fiber outer strands laid around said central core, said strands being equally spaced from each other and lubricated with a heavy, viscous lubricant, and a flexible thermoplastic material filling the space between said central core and said outer strands and between adjacent outer strands to retain the lubricant in said strands and to keep said outer strands in a fixed position relative to each other, said thermoplastic material extending outwardly to the outer periphery of said outer strands.

2. A method of producing an aramid fiber rope comprising the steps of:

winding aramid yarn into strands, coating said strands with a heavy, viscous lubricant and winding a plurality of said strands around a central core strand to form a central core, providing a plurality of aramid fiber rope strands and coating said strands with a heavy, viscous lubricant, and winding said strands so that said strands are equally spaced around said central core to form a multi-strand rope comprising a central core and outer strands, and impregnating the rope with a thermoplastic material such that the thermoplastic material fills the spaces between said central core and said outer strands and between adjacent outer strands to retain the lubricant in the strands and to keep said outer strands in a fixed position relative to each other, said thermoplastic material extending outwardly to the outer periphery of said outer rope strands.

* * * * *